United States Patent [19]

Tricarico

[11] 4,130,276

[45] Dec. 19, 1978

[54] EXERCISING DEVICE

[76] Inventor: Joseph R. Tricarico, 1955 Williamsbridge Rd., Bronx, N.Y. 10461

[21] Appl. No.: 805,082

[22] Filed: Jun. 9, 1977

[51] Int. Cl.[2] ..... A63B 69/26

[52] U.S. Cl. ..... 272/78; 272/DIG. 4

[58] Field of Search ..... 272/78, 139, 143, 135, 272/136, 137, 138, 1 B, DIG. 4; 273/DIG. 17, DIG. 18, DIG. 19, 95 A, 95 AA, 58 C, 100, 55 R, 55 B, 26 E, 26 EA

[56] References Cited

U.S. PATENT DOCUMENTS

| | | | |
|---|---|---|---|
| 795,960 | 8/1905 | Cook | 273/58 C |
| 1,753,310 | 4/1930 | Costello | 272/78 |
| 1,898,817 | 2/1933 | Dole | 273/58 C |
| 1,945,440 | 1/1934 | Maslo | 272/78 |
| 2,528,077 | 10/1950 | Pond | 272/100 X |
| 3,042,404 | 7/1962 | Masters | 272/78 X |
| 3,397,887 | 8/1968 | Caplan | 273/95 A X |
| 3,804,409 | 4/1974 | Schachner | 273/58 C X |

FOREIGN PATENT DOCUMENTS

| | | | |
|---|---|---|---|
| 728643 | 4/1932 | France | 272/78 |

*Primary Examiner*—Richard T. Stouffer
*Assistant Examiner*—Arnold W. Kramer
*Attorney, Agent, or Firm*—Daniel J. Tick

[57] ABSTRACT

An exercising device has an elastic loop positionable around a user's neck and secured by an adjustable strap connected as a loop to a ball so that the ball may be kneed, kicked and thrown.

1 Claim, 2 Drawing Figures

EXERCISING DEVICE

BACKGROUND OF THE INVENTION

The present invention relates to an exercising device. More particularly, the invention relates to an exercising device for a user having a neck and a head.

The exercising device of the invention permits the user to exercise, to a desired extent, both indoors and outdoors. The entire body, and especially the limbs, of the user may be exercised, since the user may knee, kick and throw a ball tethered to his body, as he wishes.

The exercising device comprises a ball secured by a strap to an elastic band positioned around the neck of the user.

BRIEF DESCRIPTION OF THE DRAWINGS

In order that the invention may be readily carried into effect, it will now be described with reference to the accompanying drawings, wherein.

DETAILED DESCRIPTION OF THE INVENTION

The exercising device of the invention is for a user 10 (FIG. 1) having a neck and a head.

Figure 1:
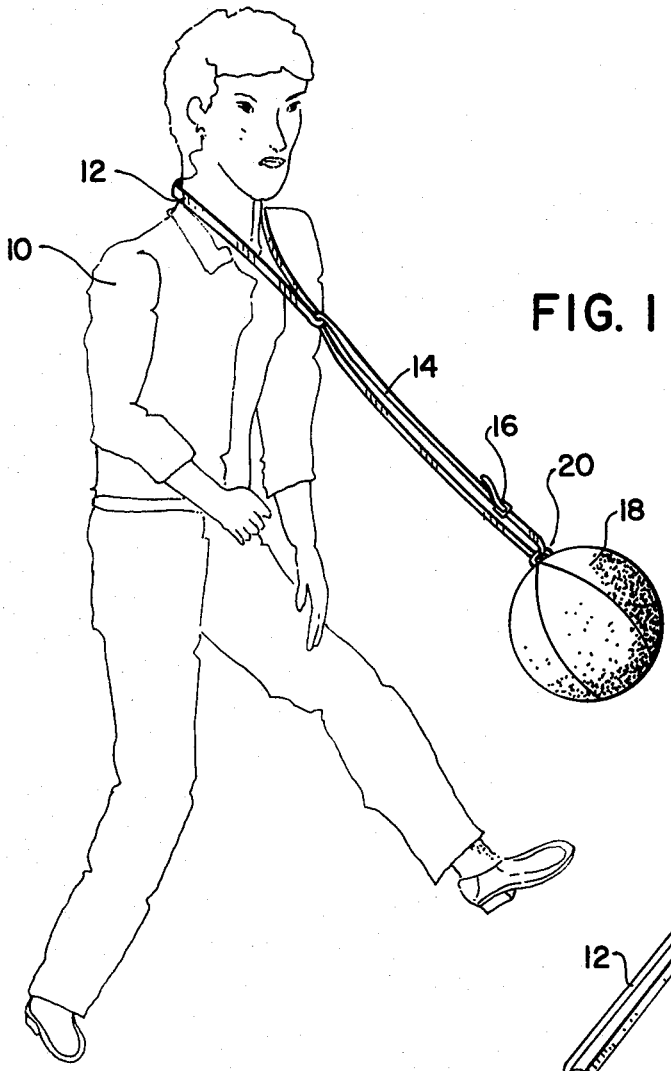
FIG. 1 is a perspective view of an embodiment of the exercising device of the invention, in use.
Figure 2:
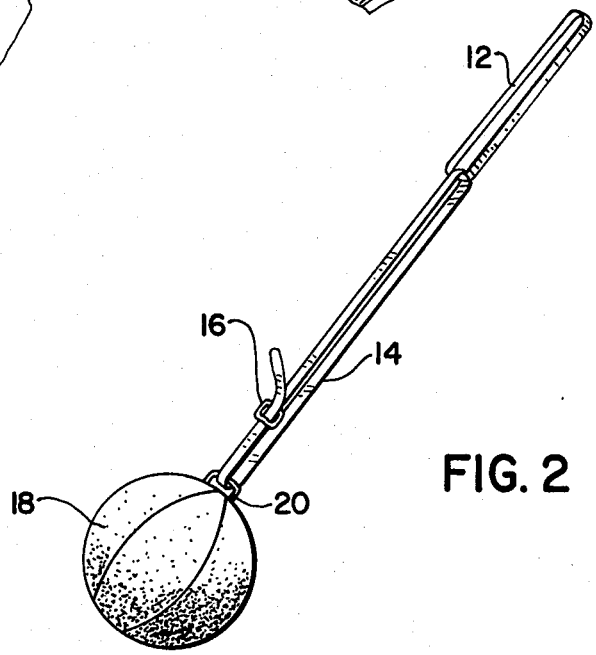
FIG. 2 is a perspective view of the embodiment of FIG. 1, on an enlarged scale.

The exercising device of the invention comprises a ball 18 (FIGS. 1 and 2) having a size substantially that of the user's head, as shown in FIG. 1. The ball 18 has an eye loop 20 extending therefrom (FIGS. 1 and 2).

A closed loop of elastic strip-like material 12 (FIGS. 1 and 2) is fittable over the user's head and around the user's neck, as shown in FIG. 1. The loop 12 may comprise any suitable elastic material A strap 14 of strip-like material of any suitable type (FIGS. 1 and 2) has spaced opposite first and second ends and an adjustable buckle 16 affixed to the first end thereof (FIGS. 1 and 2). The strap 14 passes through the eye loop 20 of the ball 18 and through the closed loop 12. The second end of the strap 14 is adjustably secured to the buckle 16 thereby providing an adjustable closed loop.

The adjustable closed loop formed by the strap 14 tethers the ball 18 to the loop 12 in a manner whereby the user 10 is enabled to knee, kick and throw said ball. The adjustability of the strap 14 via its buckle 16 enables the user 10 to adjust the length of the tether so that he may knee or kick the ball 18.

The user 10 may throw the ball 18 in the manner of a basketball and then kick it.

Having described a preferred embodiment of my invention, it is understood that various changes can be made without departing from the spirit of my invention, and, I desire to cover by the appended claims all such modifications as fall within the true spirit and scope of my invention.

What I claim and seek to secure by Letters Patent is:

1. An exercising device for a user having a neck and a head, said exercising device comprising a ball having a size substantially that of a user's head, said ball having an eye loop extending therefrom;

a closed loop of elastic strip-like material fittable over the user's head and around the user's neck; and a strap of strip-like material having spaced opposite first and second ends and a buckle affixed to the first end thereof, said strap passing through the eye loop of said ball and through said closed loop and the second end of said strap being adjustably secured to said buckle thereby providing an adjustable closed loop tethering said ball to said closed loop of elastic material in a manner whereby the user is enabled to knee, kick and throw said ball.

* * * * *